US011834733B2

(12) United States Patent
Nishi et al.

(10) Patent No.: US 11,834,733 B2
(45) Date of Patent: Dec. 5, 2023

(54) ALUMINUM ALLOY WIRE MATERIAL

(71) Applicant: Proterial, Ltd., Tokyo (JP)

(72) Inventors: Kazuya Nishi, Tokyo (JP); Toru Sumi, Tokyo (JP); Shohei Hata, Tokyo (JP)

(73) Assignee: Proterial, Ltd., Tokyo (JP)

( * ) Notice: Subject to any disclaimer, the term of this patent is extended or adjusted under 35 U.S.C. 154(b) by 0 days.

(21) Appl. No.: 17/705,535

(22) Filed: Mar. 28, 2022

(65) Prior Publication Data

US 2022/0316032 A1 Oct. 6, 2022

(30) Foreign Application Priority Data

Mar. 29, 2021 (JP) ..... 2021-055355

(51) Int. Cl.
*C22C 21/00* (2006.01)
*C22F 1/04* (2006.01)
*C21D 9/52* (2006.01)

(52) U.S. Cl.
CPC ..... *C22C 21/00* (2013.01); *C21D 9/52* (2013.01); *C22F 1/04* (2013.01)

(58) Field of Classification Search
CPC ..... C22C 21/00; C22C 21/08; C22C 21/14; C22C 21/16; C21D 9/52; C22F 1/04
See application file for complete search history.

(56) References Cited

U.S. PATENT DOCUMENTS 10,192,649 B2 * 1/2019 Nishi ..... H01B 7/0045
10,920,306 B2 * 2/2021 Sumi ..... H01B 1/023
11,355,258 B2 * 6/2022 Sumi ..... C22C 21/00
2019/0345594 A1 * 11/2019 Sumi ..... C22F 1/04

FOREIGN PATENT DOCUMENTS

JP S57-39164 A 3/1982

* cited by examiner

*Primary Examiner* — John A Hevey
(74) *Attorney, Agent, or Firm* — McCormick, Paulding & Huber PLLC

(57) ABSTRACT

Recrystallization of an aluminium alloy wire material is suppressed while a heat resistance of the same is improved. In a wire material made of an aluminium alloy, an aluminium alloy wire material is provided, the aluminium alloy containing Zr of 0.2 to 1.0 mass %, Co of 0.1 to 1.0 mass % and remainders that are aluminium and unavoidable impurities, and the aluminium alloy wire material having a tensile strength at a room temperature that is equal to or higher than 170 MPa, an elongation that is equal to or higher than 10%, and a stress at time of tensile deformation at a strain speed of $10^{-5}$/sec under a temperature condition of 250° C. that is equal to or higher than 40 MPa.

9 Claims, 1 Drawing Sheet

Table 1:

| Test workpiece | Chemical compound (mass%) | | | | Tensile strength at room temperature | Strength at 200° C | Strength at 250C | Elongation at room temperature | Electrical conductivity | Aging condition | | Cast cooling speed | | Casting temperature |
|---|---|---|---|---|---|---|---|---|---|---|---|---|---|---|
| # | Co | Ni | Ti | Zr | MPa | MPa | MPa | % | %IACS | 1st | 2nd | ° C /sec | | |
| Attainment target property | | | | | 170 or higher | 60 or higher | 40 or higher | 10 or higher | 55 or higher | | | | | |
| Working example 1 | 0.61 | - | - | 0.39 | 175 | 72 | 46 | 12.5 | 57.8 | 200° C ×5h | 350° C ×24h | Low | 8 ° C/sec | 800 |
| Working example 2 | 0.58 | - | 0.06 | 0.37 | 179 | 77 | 48 | 11.6 | 56.2 | 200° C ×5h | 350° C ×24h | Low | 8 ° C/sec | 800 |
| Working example 3 | - | 0.42 | 0.09 | 0.42 | 173 | 68 | 43 | 11.1 | 55.4 | 200° C ×5h | 350° C ×24h | High | 40 ° C/sec | 850 |
| Working example 4 | 0.58 | - | - | 0.40 | 190 | 80 | 56 | 11.5 | 55.6 | 200° C ×5h | 350° C ×24h | High | 40 ° C/sec | 850 |
| Comparative example 1 | 0.61 | - | - | 0.39 | 165 | 65 | 36 | 13.5 | 58 | - | 350° C ×24h | Low | 8 ° C/sec | 800 |
| Comparative example 2 | 0.58 | - | 0.06 | 0.37 | 168 | 71 | 38 | 13.2 | 56.6 | - | 350° C ×24h | Low | 8 ° C/sec | 800 |
| Comparative example 3 | - | 0.42 | 0.09 | 0.42 | 163 | 61 | 35 | 11.8 | 55.8 | - | 350° C ×24h | High | 40 ° C/sec | 850 |
| Comparative example 4 | 0.58 | - | - | 0.40 | 183 | 76 | 51 | 10.7 | 49.6 | - | 350° C ×24h | High | 40 ° C/sec | 850 |
| Comparative example 5 | - | - | - | 0.42 | 165 | 61 | 38 | 6.5 | 58.5 | 200° C ×5h | 350° C ×24h | Low | 8 ° C/sec | 800 |
| Comparative example 6 | - | - | - | 0.42 | 161 | 56 | 34 | 8.8 | 58.8 | - | 350° C ×24h | Low | 8 ° C/sec | 800 |

Table 1:

| Test workpiece | Chemical compound (mass%) | | | | Tensile strength at room temperature | Strength at 200° C | Strength at 250C | Elongation at room temperature | Electrical conductivity | Aging condition | | Cast cooling speed | | Casting temperature |
|---|---|---|---|---|---|---|---|---|---|---|---|---|---|---|
| # | Co | Ni | Ti | Zr | MPa | MPa | MPa | % | %IACS | 1st | 2nd | ° C /sec | | |
| Attainment target property | | | | | 170 or higher | 60 or higher | 40 or higher | 10 or higher | 55 or higher | | | | | |
| Working example 1 | 0.61 | - | - | 0.39 | 175 | 72 | 46 | 12.5 | 57.8 | 200° C ×5h | 350° C ×24h | Low | 8 ° C/sec | 800 |
| Working example 2 | 0.58 | - | 0.06 | 0.37 | 179 | 77 | 48 | 11.6 | 56.2 | 200° C ×5h | 350° C ×24h | Low | 8 ° C/sec | 800 |
| Working example 3 | - | 0.42 | 0.09 | 0.42 | 173 | 68 | 43 | 11.1 | 55.4 | 200° C ×5h | 350° C ×24h | High | 40 ° C/sec | 850 |
| Working example 4 | 0.58 | - | - | 0.40 | 190 | 80 | 56 | 11.5 | 55.6 | 200° C ×5h | 350° C ×24h | High | 40 ° C/sec | 850 |
| Comparative example 1 | 0.61 | - | - | 0.39 | 165 | 65 | 36 | 13.5 | 58 | - | 350° C ×24h | Low | 8 ° C/sec | 800 |
| Comparative example 2 | 0.58 | - | 0.06 | 0.37 | 168 | 71 | 38 | 13.2 | 56.6 | - | 350° C ×24h | Low | 8 ° C/sec | 800 |
| Comparative example 3 | - | 0.42 | 0.09 | 0.42 | 163 | 61 | 35 | 11.8 | 55.8 | - | 350° C ×24h | High | 40 ° C/sec | 850 |
| Comparative example 4 | 0.58 | - | - | 0.40 | 183 | 76 | 51 | 10.7 | 49.6 | - | 350° C ×24h | High | 40 ° C/sec | 850 |
| Comparative example 5 | - | - | - | 0.42 | 165 | 61 | 38 | 6.5 | 58.5 | 200° C ×5h | 350° C ×24h | Low | 8 ° C/sec | 800 |
| Comparative example 6 | - | - | - | 0.42 | 161 | 56 | 34 | 8.8 | 58.8 | - | 350° C ×24h | Low | 8 ° C/sec | 800 |

ALUMINUM ALLOY WIRE MATERIAL

CROSS-REFERENCE TO RELATED APPLICATION

The present application claims priority from Japanese Patent Application No. 2021-55355 filed on Mar. 29, 2021, the content of which is hereby incorporated by reference into this application.

TECHNICAL FIELD OF THE INVENTION

The present invention relates to an aluminium alloy wire material.

BACKGROUND OF THE INVENTION

In an aluminium alloy for conductor, an additive amount of an alloy element tends to be as small as possible in order to increase an electric conductivity. Therefore, in order to improve a material strength, a process hardening based on adoption of processing strain is generally used in addition to a process for achieving the alloy. As a problem of the adoption of the processing strain, reduction in ductility at a room temperature is exemplified. Increase in a temperature of the aluminium alloy significantly causes the creep deformation and the reduction in the strength due to recrystallization, and is difficult to prevent stress relaxation on a connection terminal. This stress relaxation may be a cause of increase in an electric resistance of the aluminium alloy wire material.

In order to improve the ductility of the aluminium alloy wire material at the room temperature, addition of Zr to the aluminium alloy is conceivable.

Japanese Patent Application Laid-Open Publication No. S57-39164 (Patent Document 1) describes that an aging heat treatment is performed to a casted and processed Al—Zr—Fe—Si-based aluminium alloy material.

RELATED ART DOCUMENT

Patent Document

Patent Document 1: Japanese Patent Application Laid-Open Publication No. S57-(1982-)39164.

SUMMARY OF THE INVENTION

The Zr that is a strengthening element is easy to diffuse through a crystal grain boundary at the time of the aging heat treatment, and is easy to form a coarse grain-boundary precipitate phase. However, a strength of a conductor wire made of a pure aluminium not containing Zr or a solid-solution strengthening aluminium alloy is reduced by the recrystallization at 120° C. or higher even when being increased by the process strengthening, which results in the creep deformation, and therefore, there is a problem of failing to maintain a heat resistance.

A purpose of the present invention is to suppress the recrystallization of the aluminium alloy wire material to improve the heat resistance.

The summary of the typical aspects of the inventions disclosed in the present application will be briefly described as follows.

An aluminium alloy wire material according to one embodiment is a wire material made of an aluminium alloy, the aluminium alloy contains Zr of 0.2 to 1.0 mass %, Co of 0.1 to 1.0 mass % and remainders made of aluminium and unavoidable impurities, and has a tensile strength at a room temperature that is equal to or higher than 170 MPa, an elongation that is equal to or higher than 10%, and a stress that is equal to or higher than 40 MPa at time of tensile deformation at a strain speed of $10^{-5}$/sec under a temperature condition of 250° C.

One embodiment disclosed in the present application suppresses the recrystallization of the aluminium alloy wire material to improve the heat resistance.

BRIEF DESCRIPTION OF THE DRAWINGS

Table 1 is provided in the FIGURE.

DESCRIPTIONS OF THE PREFERRED EMBODIMENTS

An embodiment will be explained in detail below.

In order to solve the above-described problem, the present inventors have studied changes of various properties in appropriate changes of a type of the alloy element, a manufacturing condition of the same and others. As a result, it has been found that it is better to use Co or Ni and Zr as the alloy element. Besides, it has been found that the recrystallization of the aluminium alloy wire material can be suppressed to improve the heat resistance when the tensile strength at the high temperature is used as an evaluation target while the strain speed of the aluminium alloy wire material is defined. The present invention has been made, based on these findings.

Embodiment

In the following, one embodiment of the present invention will be explained. In the present specification, note that a numerical range expressed with "to" means a range including previous- and post-numerical values of "to" as a lower limit value and an upper limit value.

<Aluminium Alloy Wire Material>

In the following, regarding the aluminium alloy wire material according to one embodiment of the present invention, a case of usage of Co and Zr mainly as the alloy elements will be exemplified and explained.

<Chemical Composition>

First, a chemical composition of the aluminium alloy (simply also referred to as alloy below) making the aluminium alloy wire material (simply also referred to as alloy wire material) will be explained.

The chemical composition of the alloy includes Co: 0.1 to 1.0 mass %, Zr: 0.2 to 1.0 mass %, Fe: 0.02 to 0.15 mass %, Si: 0.02 to 0.15 mass %, Mg: 0 to 0.2 mass %, Ti: 0 to 0.10 mass %, B: 0 to 0.03 mass %, Cu: 0 to 1.00 mass %, Ag: 0 to 0.50 mass %, Au: 0 to 0.50 mass %, Mn: 0 to 1.00 mass %, Cr: 0 to 1.00 mass %, Hf: 0 to 0.50 mass %, V: 0 to 0.50 mass %, Sc: 0 to 0.50 mass % and remainders: Al and unavoidable impurities.

As described later, the Co mostly reacts with the Al in a course of the manufacturing (casting) of the alloy wire material to form a crystallized product (Al—Co compound), and exists in a compound phase of the final resultant alloy wire material. The Al—Co compound practically exists in a form of an Al—Co—Fe compound absorbing the Fe that is unavoidably existing in the aluminium alloy. The Al—Co—Fe compound contributes to microfabrication of Al recrystallized grains of the alloy, and improves the elongation of the alloy wire material. The Co causes a risk of reduction in the electric conductivity of the alloy. However, when a content of the Co is 0.1 mass % to 1.0 mass %, well-balanced high-level strength, elongation and heat resistance based on the Co can be provided while the reduction in the electric conductivity of the alloy wire material based on the Co can be suppressed as effects. The content of the Co is preferably 0.2 mass % to 1.0 mass %, and more preferably 0.3 mass % to 0.8 mass %.

This specification will explain the addition of the Co having the above-described ratio. However, as described later, even a case of addition of the Ni or the Fe having the same amount in place of the Co can provide the same effect as that in the case of the addition of the Co having the above-described ratio.

As described later, the Zr is mainly solid soluble in an ingot (cast material) after the casting, but precipitates as an Al—Zr compound in the alloy wire material after the aging heat treatment. The Al—Zr compound mainly contributes to the improvement of the heat resistance of the alloy wire material. An excessive large content of the Zr causes a risk of the reduction in the ductility of the alloy in the course of the manufacturing of the alloy wire material to prevent the alloy wire material from thinning. In this regard, when the content of the Zr is 0.2 mass % to 1.0 mass %, the ductility of the alloy can be maintained to be high, and besides, the alloy wire material can be provided with the desirable heat resistance. The content of the Zr is preferably 0.3 mass % to 0.6 mass %.

The Fe is a component that derives from an aluminium raw material and is unavoidably contained. The Fe contributes to the improvement of the strength of the alloy. When the Fe is crystallized out as $FeAl_3$ at the time of the casting or precipitates as $FeAl_3$ during the aging heat treatment, the Fe causes a risk of the reduction in the ductility of the alloy to prevent the alloy wire material from thinning at the time of the manufacturing. In the present embodiment, since the Co is blended, the Fe is absorbed when the Al—Co compound is crystallized out, and the Al—Co—Fe compound is formed. In this manner, since the Fe is converted into the Al—Co—Fe compound, the formation of the $FeAl_3$ is suppressed. As a result, the strength of the alloy can improve along with the suppression of the reduction in the ductility of the alloy. The content of the Fe is preferably equal to or lower than the content of the Co for being absorbed into the Al—Co compound, and is set to 0.02 mass % to 0.15 mass %. This manner can provide the high strength and thin the alloy wire material. The content of the Fe is preferably 0.04 mass % to 0.15 mass %. Note that the Fe may be added to have a predetermined content.

The Si is a component that derives from the aluminium raw material and is unavoidably contained as similar to the Fe. The Si contributes to the improvement of the strength of the alloy when being solid soluble in the Al crystal grains of the alloy or precipitating together with the Fe. The Si causes risks of reduction in the elongation of the alloy and the prevention of the thinning of the alloy wire material as similar to the Fe. However, when a content of the Si is 0.02 mass % to 0.15 mass %, the strength can improve along with the suppression of the reduction in the elongation of the alloy. The content of the Si is preferably 0.04 mass % to 0.12 mass %. Note that the Si may be added to have a predetermined content.

In the alloy of the present embodiment, the Ti is replaced with a part of Zr atoms of the Al—Zr compound that is formed in the alloy wire material after the aging heat treatment, and precipitates as an Al—Zr—Ti compound. The Al—Zr—Ti compound has the same crystal structure as that of the Al—Zr compound, and mainly contributes to the improvement of the heat resistance of the alloy wire material. As similar to the Zr, an excessive large content of the Ti causes a risk of reduction in the ductility of the alloy in the course of the manufacturing of the alloy wire material to prevent the alloy wire material from thinning. In this regard, when the content of the Ti is 0 mass % to 0.1 mass %, the ductility of the alloy can be maintained to be high, and besides, the alloy wire material can be provided with the desirable heat resistance.

The Mg, the B, the Cu, the Ag, the Au, the Mn, the Cr, the Hf, the V and the Sc are optional components that derive from the aluminium raw material and are contained or appropriately added if needed. The optional components described in the specification mean as components that may be contained or not contained. Each alloy element suppresses the crystal grains of the Al phase from being coarse in the alloy wire material, and contributes to the improvement of the strength. The Cu, the Ag and the Au of these elements can improve the grain boundary strength when precipitating into the crystal grain boundary. When each content of each alloy element is set in the above-described range, the effect based on each alloy element along with the suppression of the reduction in the elongation of the alloy can be provided.

The remainders except for the above-described components are the Al and the unavoidable impurities. The unavoidable impurities described in the specification are unavoidably contained because of the manufacturing steps of the alloy wire material, and mean materials, a content of which is as small as not affecting the properties of the alloy wire material. As the unavoidable impurities, for example, Ga, Zn, Bi, Pb and others are exemplified.

In a point of view of the electric conductivity of the alloy wire material, a content of the Al is preferably equal to or more than 97 mass %, more preferably equal to or more than 98 mass %, or still more preferably equal to or more than 98.4 mass %.

<Metal Structure>

Next, a metal structure of the aluminium alloy will be explained.

The aluminium alloy wire material according to the present embodiment has a metal structure including the Al crystal grains, the Al—Co—Fe compound and the Al—Zr compound. In the metal structure, the Al—Co—Fe compound and the Al—Zr compound diffusely exist in the crystal grain boundary.

The Al—Co—Fe compound is a crystallized-out phase that is formed at the time of solidifying of the molten liquid metal by cooling in the casting of the aluminium alloy or formed at the time of cooling of the solidified and high-temperature cast material cooled down to nearly the room temperature. In other words, the Al—Co—Fe compound is a crystallized-out product that is formed in the aluminium alloy of the cast material.

The Al—Zr compound is a precipitated phase that is formed at the time of heating and maintaining of the cast material cooled down to the room temperature under a high temperature atmosphere equal to or lower than a melting point by the aging heat treatment. More specifically, this is a precipitated product that is finally formed when the solid-soluble metal elements in the Al phase of the cast material are diffused and gathered in the Al phase by the aging heat treatment. In other words, the precipitated product does not exist in the Al alloy of the cast material but exists in the alloy wire material subjected to the aging heat treatment.

A size distribution of the Al—Zr compound is in a range that is equal to or larger than 1 nm and equal to or smaller than several hundreds of nm. A ratio of fine precipitated products with a size that is equal to or larger than 1 nm and equal to or smaller than 100 nm is preferably larger than a ratio of precipitated products without the size that is equal to or larger than 1 nm and equal to or smaller than 100 nm. When the size of the precipitated product made of the Al—Zr compound is equal to or larger than 1 nm and equal to or smaller than 100 nm, the number of the precipitated products can be made large even if the contents of the alloy elements are small, and therefore, the well-balanced effect based on the precipitated products can be provided. Besides, the ductility of the alloy can be maintained to be high, and therefore, the processability in the elongation step can be made high, and the alloy wire material can be more thinned.

A size of the Al—Co—Fe compound is preferably equal to or larger than 20 nm and equal to or smaller than 1 μm (1000 nm). The Al—Co—Fe compound can be made large by, for example, the sufficient aging time. When the compound is too small, the ductility of the alloy wire material is often reduced. In this regard, when the size is equal to or larger than 20 nm, the ductility can be made high. On the other hand, when the compound is too large, the recrystallization is easy to occur at the time of the again heat treatment, and the crystal grain size is coarse and large, and therefore, the strength of the alloy wire material is often reduced. In order to provide the high strength, the size of the compound is preferably equal to or smaller than 1 μm. Note that the Co atom diffuses in the Al structure at a higher speed than that of the Zr atom, and therefore, the size of the Al—Co—Fe compound is larger than the Al—Zr compound. As described later, a role of the Al—Co—Fe compound is to suppress the growth of the recrystallized grains at the time of an early stage of the aging heat treatment. Therefore, in the metal structure after the end of the aging heat treatment, the Al—Co—Fe compound can be larger than the Al—Zr compound.

Shapes of the compounds are not particularly limited, but the Al—Co—Fe compound preferably has a spherical shape or a spheroidal shape. The Al—Zr compound preferably has a spherical shape, but may have an uncertain shape. Note that the spheroidal shape is a shape that is circular in a vertical direction to a longitudinal direction of the wire material but ellipsoidal in a parallel direction to the longitudinal direction of the wire material.

(Properties of Aluminium Alloy Wire Material)

The aluminium alloy wire material of the present embodiment is made of an aluminium alloy having the above-described chemical composition and metal structure. Specifically, the alloy wire material has a tensile strength at a room temperature that is equal to or high than 170 MPa and elongation that is equal to or higher than 10%. And, a stress at the time of tensile deformation at a strain speed of $10^{-5}$/sec under a temperature condition of 200° C. is equal to or higher than 60 MPa. Further, a stress at the time of tensile deformation at a strain speed of $10^{-5}$/sec under a temperature condition of 250° C. is equal to or higher than 40 MPa. Still further, this has an electric conductivity that is equal to or higher than 55% IACS.

A wire diameter of the alloy wire material is preferably equal to or less than 1 mm in a point of view of the flexibility, and more preferably 0.3 mm to 1 mm.

<Method of Manufacturing Aluminium Alloy Wire Material>

Next, a method of manufacturing the aluminium alloy wire material will be explained. The aluminium alloy wire material of the present embodiment can be manufactured by sequential steps that are a preparation step of the molten liquid metal, a casting step, a shaping step, an elongation step and an aging heat treatment step. Each step will be described in detail below.

<Preparation Step>

First, a molten liquid metal for use in forming the aluminium alloy wire material is prepared. In the present embodiment, an Al raw material, a Co raw material, a Zr raw material, and other alloy raw materials if needed are mixed in order to prepare the molten liquid metal having the above-described chemical composition. Then, these raw materials are introduced into, for example, a melting furnace, and are melted by heating using a burner or others. The mixing method and the melting method of the raw materials are not particularly limited, and can be performed by a related-art method. This specification explains a case of addition of the Zr raw material and the Co raw material to the Al raw material. However, Ni, Fe, or Ti raw material may be added instead of the Co raw material.

The resultant molten liquid metal is conveyed to and stored in a reservoir (that is so-called tundish). The reservoir has a pouring nozzle, and the molten liquid metal can be flown out of the reservoir.

<Casting Step>

Next, the molten liquid metal is flown out of the reservoir through the pouring nozzle, and is poured into a mold. Regarding the mold, for example, a belt-wheel type continuous casting machine allowing continuous casting can be used. The continuous casting machine includes, for example, a belt and a columnar wheel having a groove on its outer circumferential surface, and this belt is configured to be hooked to a part of the outer circumferential surface of the wheel. By the continuous casting machine, the molten liquid metal is poured into a space (the groove part) between the wheel and the belt and is solidified by cooling, so that the cast material can be continuously formed.

In the present embodiment, a temperature of the molten liquid metal (casting temperature) is set to 800° C. or 850° C. When the temperature of the molten liquid metal (casting temperature) is 800° C., the cooling is relatively slowly performed in the mold. On the other hand, when the temperature of the molten liquid metal (casting temperature) is highly set to 850° C. or higher, the molten liquid metal is rapidly cooled in the mold. In this manner, the cast material is formed so that the Co is crystallized out while the crystallization out of the Zr is suppressed. This point will be described in detail below.

First, in the case of the rapid cooling of the molten liquid metal, the Co can be crystallized out while the crystallization out of the Zr can be suppressed (the Zr can remain being solid-soluble) as described below.

According to the studies of the present inventors, when the Zr forms the crystallized product with the Fe in the cast material, the ductility of the cast material is often reduced so that it is difficult to process the cast material to be elongated. On the other hand, the Co does not affect the ductility of the cast material much even when forming the crystallized product with the Fe. Therefore, it is desirable to crystallize out the Co but not crystallize out the Zr so that the Zr remains being solid-soluble. However, not many but a small amount of the Zr is crystallized out together with the Co by the cooling of the molten liquid metal, and therefore, it is difficult to selectively make only the Zr solid-soluble.

In this regard, the present inventors have paid attention to more easiness of the crystallization out (precipitation) of the Co than the Zr at the time of the cooling of the molten liquid metal and a larger crystallization speed (precipitation speed) of the Co than the Zr. The difference in the crystallization speed is caused by difference in a diffusion speed in the aluminium solid phase.

In more specific explanation, the Co in the Al solid phase has a diffusion speed that is equal to or higher than a self diffusion speed of the Al. Besides, a solid-soluble degree of the Co in the Al phase in thermal equilibrium is lower than 0.05% at maximum to be excessively small. Therefore, the Co is easy to gather in the Al structure and to be crystallized out even immediately after the casting and the solidification from the molten liquid metal. By the crystallization-out, most of the Co in the ingot (cast material) after the casting is crystallized out as the compound in the Al structure. Note that the Al phase immediately after the solidification includes not only the crystallized-out compounds but also the solid-soluble Co atoms. Immediately after the solidification, oversaturated Co atoms that are more than the thermal-equilibrium solid-soluble degree are solid-solved in the Al phase. However, the oversaturated and solid-solved Co atoms are gathered in relatively short time when being diffused in the Al phase at a high speed, and form a compound phase. As a result, most of the added Co atoms exist as the compound phase with the Al in the course of the cooling step of the cast material down to the room temperature after the casting and the solidification, and an amount of the solid-soluble Co atoms in the Al phase is only less than 0.1% that is nearly a thermal equilibrium concentration to be small.

On the other hand, the Zr in the Al phase has the diffusion speed that is significantly smaller than the self diffusion speed of the Al, and its precipitation speed in the Al structure that is smaller than that of the Co. Besides, the maximum solid-soluble degree of the Zr in the Al phase in the thermal equilibrium state is about 0.3 to 0.4% that is several times larger than that of the Co. Therefore, the Zr is difficult to be crystallized out in the cast material after the casting, and most of this is solid-soluble to be oversaturated in the Al structure. The Zr has the significantly slower diffusion than the Co, and therefore, remains being oversaturated and solid-soluble even when the cast material after the casting is stored at the room temperature for a long time. The oversaturated solid-soluble Zr can be precipitated by the aging heat treatment for heating at a temperature of, for example, 300° C. or higher.

Therefore, the present inventors have thought up that the Zr is allowed to remain being solid-soluble by the solidification of the molten liquid metal before the start of the crystallization out of the Zr, and have studied a speed of cooling the molten liquid metal. As a result, the present inventors have found out that, in the resultant cast material, as the speed of cooling the molten liquid metal is higher, the Zr is more allowed to remain being solid-soluble along with the suppression of the crystallization out of the Zr while most of the Co is crystallized out as the Al—Co—Fe compound. Since the Zr is solid-solved, the reduction in the ductility of the cast material due to the crystallization out of the Zr can be suppressed. In other words, in the cast material having the less crystallized-out Zr, the disconnection can be suppressed even after the highly-processed elongation in comparison to the cast material having the crystallized-out Zr, and therefore, the alloy wire material having the small wire diameter can be manufactured.

Besides, when the temperature of the molten liquid metal is equal to or higher than 850° C., solid-soluble limitation of the Zr in the Al can be increased. In this manner, even when the content of the Zr is largely set to, for example, 0.5 mass % to 1.0 mass %, the Zr is not crystallized out but is allowed to be solid soluble. Note that the upper limit of the temperature of the molten liquid metal is not particularly limited if the Zr is allowed to be solid soluble, but is preferably to be, for example, equal to or lower than 900° C., and more preferably equal to or lower than 870° C.

A metal structure of the resultant cast material in the casting step is mainly made of the Al crystal grains surrounded by a large tilt grain boundary, and the Co and the Fe form the Al—Co—Fe compound at the boundary to be crystallized out. Because of the formation of the Al—Co—Fe compound, the solid-soluble Fe that is a cause of the reduction in the electric conductivity is less in the Al phase, and the precipitate ($FeAl_3$) that is a cause of the reduction in the elongation is also less therein. Note that the Zr is not crystallized out but solid soluble in the Al phase and the grain boundary.

Note that the Al—Co—Fe compound does not reduce the ductility of the Al alloy as different from the $FeAl_3$ compound, and therefore, does not interrupt the reduction in the diameter of the alloy wire material. Note that the Al—Co—Fe compound is a compound containing at least the Al, the Co and the Fe, and may contain other metal elements. The Al—Co—Fe compound in the ingot after the casting has an elongated shape.

In the casting step, the temperature of the molten liquid metal flown out of the pouring nozzle of the reservoir is lowered in the course of the pouring into the mold, and the solid-soluble Zr in the Al often starts to be crystallized out. Therefore, in order to suppress the crystallization out of the Zr in the course from the reservoir to the mold, it is preferable to heat the poured molten liquid metal, the temperature is preferably maintained to be equal to or higher than 800° C., and more preferably maintained to be equal to or higher than 850° C. In this manner, the temperature in the poring of the molten liquid metal can be securely suppressed from being lowered, and various properties of the alloy wire material can be improved.

A method of heating the molten liquid metal flown out of the poring nozzle is not particularly limited. However, a publicly-known heating means such as a burner, an electric-wave heating machine, a high-frequency heating machine or others can be used to be arranged between the poring nozzle and the mold. Such a heating means may be arranged between the poring nozzle and the mold so that the molten liquid metal flown out of the poring nozzle can be heated.

In order to solidify the molten liquid metal while the Zr remains being solid soluble in the casting step, the cooling speed is preferably equal to or higher than 8° C./sec, more preferably equal to or higher than 20° C./sec, and may be, for example, 40° C./sec. An upper limit of this is not particularly limited, but may be equal to or lower than 200° C./sec. In order to reliably achieve such a cooling temperature, not a twin-roll type but a Properzi type continuous casting machine may be used.

Note that the cooling speed may be adjusted by appropriate change in a thickness of the mold. For example, by a thick mold, a ratio of a cross-sectional area of the mold with respect to a cross-sectional area of the space of the mold (a cross-sectional area of the cast material) may be set to high to improve a heat-release efficiency. And, the cooling speed is represented by a value of division of a difference between the temperature (such as 850° C.) of the molten liquid metal at the time of the pouring of the molten liquid metal into the mold and the solidifying temperature of the molten liquid metal poured into the mold by time taken from the pouring of the molten liquid metal into the mold to the solidification of the molten liquid metal.

<Shaping Step>

Subsequently, the cast material is shaped into a bar shape (that is so-called wire rod) if needed so that the cast material is easy to be elongated. In this step, a plastic process is performed to the cast material to have the wire diameter of, for example, 5 mm to 50 mm. As the plastic process, a related-art publicly-known method such as a rolling process, a swaging process or a pulling-out process may be performed.

<Elongating Step>

Subsequently, a cold-work elongation process is performed to the bar-shaped cast material to form an elongated wire having a predetermined wire diameter. As the elongating process, a related-art publicly-known method such as a pulling-out elongating process using dies may be performed. Note that a process performance is a ratio of the difference between the cross-sectional area of the cast material and the cross-sectional area of the elongated wire material with respect to the cross-sectional area of the cast material, and indicates a ratio of area reduction in the elongating step.

In the metal structure of the resultant elongated wire material in the elongating step, the Al crystal grains are pulled and elongated in an elongating direction by the elongating process, so that the process strain is introduced. The crystallized-out Al—Co—Fe compound in the cast material is finely crashed by the elongating process, and therefore, is finely and densely diffused in the metal structure of the elongated wire material.

The present embodiment suppresses the crystallization out of the Zr to make the cast material having the high ductility, and therefore, can increase the process performance of the elongating process. In order to finely crash the Al—Co—Fe compound and finely diffuse it in the elongated wire material, the cast material is elongated to have the cross-sectional area that is equal to or lower than 0.01 times, and the wire diameter of the elongated wire material is preferably equal to or smaller than 2.0 mm. By such a process performance, the size of the Al—Co—Fe compound after the elongation can be easy to be controlled to be 20 nm to 1 μm. Also, in the precipitation of the Zr in the later-described aging heat treatment, the size of the Al—Zr compound can be also easy to be controlled to be 1 nm to 100 nm. Besides, in the final alloy wire material, the precipitates can be further diffused and precipitated.

In the present embodiment, note that an annealing process (that is so-called intermediate annealing process) for relieving the process strain in the elongation can be eliminated since the cast material has the high ductility. Therefore, the Al crystal grains can be further suppressed from being coarse and large due to the recrystallization.

<Aging Heat Treatment Step>

Subsequently, the aging heat treatment is performed to the elongated wire material to provide the alloy wire material of the present embodiment.

The aging heat treatment precipitates the solid-soluble Zr in the Al phase as the Al—Zr compound, and besides, relieves the process strain introduced to the metal structure of the elongate wire material. The present embodiment can suppress the recrystallization of the Al by finely diffusing the Co compound in the elongated wire material, and can relieve the process strain by recovering the Al crystal.

In the present embodiment, the aging heat treatment is separately performed twice. In other words, the aging heat treatment includes two heat treatment steps (that are a first heat treatment and a second heat treatment). In the first heat treatment, the elongated wire material is heated at 200° C. for 1 to 10 hours. In the following second heat treatment, the elongated wire material is heated at 300 to 350° C. for 20 hours or longer. These heat treatments are performed under the atmospheric pressure. And, these heat treatments are performed under air or inert atmosphere such as Ar gas. In this example, the temperature of the elongated wire material is lowered down to the room temperature in the course between the first heat treatment and the second heat treatment. However, the first heat treatment and the second heat treatment may be continuously performed without the lowering of the temperature of the elongated wire material down to the room temperature.

At a stage of the heating retention at 200° C. in the first heat treatment, the process strain slightly disappears, and subgrains are formed by the disappearance. The solid-soluble Zr atoms are extremely slowly diffused, but are gathered by high-speed diffusion through the subgrains to form the fine Al—Zr compound even at this stage. And, it is expected that a core of the Al—Zr compound is formed even in a matrix region in the subgrains by short movement of the Zr atoms. By the first heat treatment at the relative low temperature, many fine particles of the Al—Zr compound can be preliminarily formed inside the Al alloy.

When the temperature of the following second heat treatment is set to 300° C. or higher, the subgrain boundary that is formed in the first heat treatment can be grown, and therefore, the ductility of the alloy wire material can be increased. Besides, since the Al—Zr compound is easy to be precipitated, the strength can be increased while the electric conductivity of the alloy wire material is maintained to be high. On the other hand, when the temperature is set to 350° C. or lower, the recrystallization can be suppressed, and the subgrain boundary cannot be lost but be maintained, and therefore, the strength of the alloy wire material can be highly maintained.

Time (treatment time) for heating the elongated wire material in the second heat treatment is preferably 20 to 100 hours. By the setting to 20 to 100 hours, the Al—Zr compound is sufficiently precipitated while the manufacturing cost is maintained to be low, and therefore, the electric conductivity of the alloy wire material can be increased while the strength can be increased.

As described above, the fine Al—Zr precipitation phase can be more diffused in the crystal grains of the alloy wire material by the two aging heat treatments in comparison to, for example, a case without the first heat treatment in the aging heat treatment. In this manner, the strength of the alloy wire material can be increased.

<Effect According to Present Embodiment>

The present embodiment provides the following single or plural effects.

As a test for evaluating the properties of the aluminium alloy wire material, measurement of the tensile strength of the aluminium alloy wire material at the room temperature is conceivable. However, such an evaluation method cannot detect the reduction in the tensile strength caused by the creep deformation of the aluminium alloy wire material under a high temperature condition, and cannot secure the reliability of the aluminium alloy wire material. In the aluminium alloy wire material used for a connection terminal, the stress is relieved under the high temperature condition. As a result, an electric resistance of the aluminium alloy wire material increases.

On the other hand, the aluminium alloy wire material of the present embodiment is a wire material containing the Zr of 0.3 to 0.6 mass % and the Co, the Ni, the Fe or the Ti of 1.0 mass % or less and having the diameter of 0.1 mm or smaller. This aluminium alloy wire material has the tensile strength at the room temperature that is equal to or higher than 170 MPa and the elongation that is equal to or higher than 10%. The stress at time of the tensile deformation at the strain speed of $10^{-5}$/sec under the temperature condition of 200° C. is equal to or higher than 60 MPa. The stress at time of the tensile deformation at the strain speed of $10^{-5}$/sec under the temperature condition of 250° C. is equal to or higher than 40 MPa. And, this aluminium alloy wire material has the electric conductivity that is equal to or higher than 55% IACS.

As described above, the predetermined tensile strengths can be secured even under the high temperature conditions that are equal to or higher than 200° C. and 250° C. The high tensile strength under the high temperature condition means that it is difficult to relieve the stress of the alloy wire material. Therefore, at the connection terminal made of the aluminium alloy wire material, the terminal can be prevented from being loosened. In other words, the electric resistance due to the stress relief can be prevented from increasing. As reasons for providing such effects, the above-described composition of the aluminium alloy wire material and the two separate stages of the aging heat treatment are exemplified. In this case, because of the two separate stages of the aging heat treatment, the fine Al—Zr precipitation phase stabilizes the subgrain structure formed at the time of the high temperature deformation. This manner can provide the high anti-creep-deformation property. Therefore, the heat resistance of the aluminium alloy wire material can be increased.

And, when the cooling temperature of the molten liquid metal is highly set, many additional elements can be solid soluble, and therefore, the tensile strength of the aluminium alloy wire material can be increased. For example, the cooling speed at the time of the casting of the molten liquid metal is preferably set to be equal to or higher than 20° C./sec. By the cooling of the molten liquid metal under such a condition, the Co can be finely diffused to be crystallized out while the crystallization out of the Zr is reliably suppressed. This manner can provide the various well-balanced high-level properties.

In the above-described present embodiment, the alloy wire material using the Co and the Zr as the alloy elements has been explained. However, the present invention is not limited to this, and the Ni can be used in place of the Co.

A chemical composition of the alloy includes a chemical composition made of Ni: 0.1 to 1.0 mass %, Zr: 0.2 to 1.0 mass %, Fe: 0.02 to 0.15 mass %, Si: 0.02 to 0.15 mass %, Mg: 0 to 0.2 mass %, Ti: 0 to 0.10 mass %, B: 0 to 0.03 mass %, Cu: 0 to 1.00 mass %, Ag: 0 to 0.50 mass %, Au: 0 to 0.50 mass %, Mn: 0 to 1.00 mass %, Cr: 0 to 1.00 mass %, Hf: 0 to 0.50 mass %, V: 0 to 0.50 mass %, Sc: 0 to 0.50 mass % and remainders: Al and unavoidable impurities.

Most of the Ni reacts with the Al in the course of the manufacturing (casting) of the alloy wire material to form a crystallized-out product (Al—Ni compound), and exists as a compound phase in the final resultant alloy wire material. The Al—Ni compound practically exists in a form of an Al—Ni—Fe compound absorbing the Fe unavoidably existing in the aluminium alloy. The Al—Ni—Fe compound contributes to microfabrication of Al recrystallized grains of the alloy, and improves the elongation of the alloy wire material. The Ni causes a risk of reduction in the electric conductivity of the alloy. However, when a content of the Ni is 0.1 mass % to 1.0 mass %, well-balanced high-level strength, elongation and heat resistance based on the Ni can be provided while the reduction in the electric conductivity of the alloy wire material based on the Ni can be suppressed as effects. The content of the Ni is preferably 0.2 mass % to 1.0 mass %, and more preferably 0.3 mass % to 0.8 mass %. In the case of manufacturing the alloy wire material using the Ni, the alloy wire material may be manufactured as similar to the case of the Co. The resultant alloy wire material has the same metal structure as that of the alloy wire material using the Co, and has the above-described properties.

WORKING EXAMPLES

Next, based on working examples, the present invention will be further explained in detail with reference to a table 1. However, the present invention is not limited to these working examples.

<Manufacturing of Alloy Wire Material>

Working Example 1

In a working example 1, the aluminium having a purity of 99.7%, the Co and the Zr were blended so that the composition of the Co and the Zr are as shown in the table 1, and were melted by a high-frequency melting furnace under the argon atmosphere. The temperature of the resultant molten liquid metal was adjusted to 800° C., and then, the molten liquid metal was poured and casted in a copper-made water cooling mold (having an inner diameter: φ 15 mm), so that the cast material having the predetermined chemical composition was provided. In the present working example, the burner was arranged to heat the molten liquid metal to be poured, and the temperature of the molten liquid metal to be poured was maintained to be equal to or higher than 800° C. The cooling speed of the molten liquid metal was adjusted to be 8° C./sec (seconds). The cast material was formed into the columnar shape having sizes of an outer diameter φ 15 mm and a length of 150 mm. This cast material was shaped into a wire rod having φ 9.5 mm by the swaging process, and then, was repeatedly subjected to the elongating process based on the pulling out using the dies, so that the wire material was thinned to have φ 0.45 mm. In the elongating process using the dies, the intermediate heat treatment was not performed. The two-stage aging heat treatments were performed to the resultant wire material having φ 0.45 mm to manufacture the alloy wire material of the working example 1. In this aging heat treatment, the wire material was stayed in a salt bath at 200° C. for 5 hours in the first heat treatment, and then, the wire material was stayed in a salt bath at 350° C. for 24 hours in the second heat treatment.

Working Example 2

In a working example 2, the alloy wire material was manufactured as similar to the working example 1, except for the further addition of the Ti and the change of each additional amount of the Co and the Zr as shown in the composition in the table 1.

Working Example 3

In a working example 3, the alloy wire material was manufactured as similar to the working example 1, except for the additions of the Ni and the Ti in place of the Co, the change of the additional amount of the Zr as shown in the composition in the table 1, the temperature of the molten liquid metal at the time of the casting to be set to 850° C., and the cooling speed to be set to 40° C./sec (seconds).

Working Example 4

In a working example 4, the alloy wire material was manufactured as similar to the working example 1, except for the change of each additional amount of the Co and the Zr as shown in the composition in the table 1, the temperature of the molten liquid metal at the time of the casting to be set to 850° C., and the cooling speed to be set to 40° C./sec (seconds).

Comparative Examples 1 to 4

In comparative examples 1 to 4, the alloy wire material was manufactured as similar to the working examples 1 to 4, except that the aging heat treatment was performed not twice (two-stage) but only once (the wire material was stayed in the salt bath at 350° C. for 24 hours).

Comparative Example 5

In a comparative example 5, the alloy wire material was manufactured as similar to the working example 1, except for the change of the additional amount of the Zr without the addition of the Co.

Comparative Example 6

In a comparative example 6, the alloy wire material was manufactured as similar to a comparative example 5, except that the aging heat treatment was performed not twice (two-stage) but only once (the wire material was stayed in the salt bath at 350° C. for 24 hours).

(Evaluation Method)

In the manufactured alloy wire material, the tensile strength, the elongation and the electric conductivity were evaluated by the following method.

<Tensile Strength and Elongation>

The tensile strength and the elongation of the alloy wire material were measured in a tensile test (test method (test speed: 20 mm/minutes) in conformity with JIS Z2241) for the alloy wire material. As a load cell for measuring the strength, a 50N-capacity type load cell manufactured by Shimadzu corporation was used.

Regarding the tensile strengths in the present working examples, the tensile strength at the room temperature (25±5° C.), the tensile strength at 200° C., and the tensile strength at 250° C. were measured. A gauge length before the test in each example was set to 100 mm, and the stress at the time of the tensile deformation at the strain speed $10^{-5}$/sec was measured as each of the tensile strength at 200° C. and the tensile strength at 250° C. In each measurement at 200° C. and 250° C., both ends of a wire material having a diameter of 0.45 mm that is a test sample were fixed to a holding jig, and the test sample was heated in a thermostat bath while a cross head position of a test machine is adjusted so that a tensile force exceeding 0.5 N is not applied to the test sample. The temperature was retained for two hours or longer after reaching a target temperature in order to stabilize the temperature, and then, the tensile test was performed. A thermocouple was attached to the holding jig of the wire material, and a test temperature was measured.

In the present working examples, if a sample has the tensile strength at the room temperature that is equal to or higher than 170 MPa, the tensile strength at 200° C. that is equal to or higher than 60 MPa, and the tensile strength at 250° C. that is equal to or higher than 40 MPa, then, the sample was evaluated to have a high strength. And, if a sample has the elongation at the room temperature that is equal to or higher than 10%, then, the sample was evaluated to have a high elongation.

<Electric Conductivity>

Regarding the electric conductivity of the alloy wire material, the electric conductivity was calculated by a direct-current four probe method from a measurement result of the electric resistance of the manufactured alloy wire material at 20° C. In the present working examples, if a sample has the electric conductivity that is equal to or higher than 55% IACS, then, the sample was evaluated to have a high electric conductivity.

<Evaluation Result>

As results of the measurements for various properties of the alloy wire materials of the working examples 1 to 4, it has been confirmed that all samples pass the test because of having the tensile strength at the room temperature that is equal to or higher than 170 MPa, the tensile strength at 200° C. that is equal to or higher than 60 MPa, the tensile strength at 250° C. that is equal to or higher than 40 MPa, the elongation that is equal to or higher than 10%, and the electric conductivity that is equal to or higher than 55% IACS as shown in the table 1.

On the other hand, the alloy wire materials of the comparative examples 1 to 6 did not satisfy all of the conditions as shown in the table 1.

As results of studies on the difference in the evaluation results between the working examples and the comparative examples, it has been confirmed that the property difference depends on the metal structure of the alloy wire material.

As the above-described results, the highly-reliable aluminium alloy wire material having the well-balanced high-level strength, elongation and electric conductivity can be provided when the aluminium alloy wire material is manufactured by the additions of the Zr and the Co, the Ti or the Ni as the alloy elements to the molten liquid aluminium and the two-stage aging heat treatments to the alloy wire material casted from this molten liquid metal.

In the foregoing, the invention made by the present inventors has been concretely described on the basis of the embodiments. However, it is needless to say that the present invention is not limited to the foregoing embodiments, and various modifications can be made within the scope of the present invention.

In addition, a part of the contents described in the embodiment will be described below.

(Statement 1)

A method of manufacturing an aluminium alloy wire material includes:

(a) a step of pouring a molten liquid aluminium into a mold to cast a cast material;

(b) a step of rolling the cast material to form a copper wire rod;

(c) a step of elongating the copper wire rod to form an aluminium alloy wire material; and (d) a step of performing a first heat treatment to the aluminium alloy wire material, and then, performing a second heat treatment thereto at a higher temperature than that of the first heat treatment, the aluminium alloy wire material contains Zr of 0.2 to 1.0 mass %, Co of 0.1 to 1.0 mass % and remainders that are aluminium and unavoidable impurities or contains Zr of 0.2 to 1.0 mass %, Ni of 0.1 to 1.0 mass % and remainders that are aluminium and unavoidable impurities, the aluminium alloy wire material has a tensile strength at a room temperature that is equal to or higher than 170 MPa, an elongation that is equal to or higher than 10%, and a stress that is equal to or higher than 40 MPa at time of tensile deformation at a strain speed of $10^{-5}$/sec under a temperature condition of 250° C.

(Statement 2)

In the method of manufacturing the aluminium alloy wire material described in the (Statement 1), in the step (a), the cast material is casted by cooling of the molten liquid metal at a speed that is equal to or higher than 40° C./sec.

(Statement 3)

In the method of manufacturing the aluminium alloy wire material described in the (Statement 1 or 2), in the step (d), treatment time of the second heat treatment is longer than treatment time of the first heat treatment.

The invention claimed is:

1. An aluminium alloy wire material made of an aluminium alloy, wherein the aluminium alloy contains Zr of 0.2 to 1.0 mass %, Co of 0.1 to 1.0 mass % and remainders that are aluminium and unavoidable impurities, a tensile strength at a room temperature is equal to or higher than 170 MPa, an elongation is equal to or higher than 10%, and a stress at time of tensile deformation at a strain speed of $10^{-5}$/sec under a temperature condition of 250° C. is equal to or higher than 40 MPa.

2. An aluminium alloy wire material made of an aluminium alloy, wherein the aluminium alloy contains Zr of 0.2 to 1.0 mass %, Ni of 0.1 to 1.0 mass % and remainders that are aluminium and unavoidable impurities, a tensile strength at a room temperature is equal to or higher than 170 MPa, an elongation is equal to or higher than 10%, and a stress at time of tensile deformation at a strain speed of $10^{-5}$/sec under a temperature condition of 250° C. is equal to or higher than 40 MPa.

3. The aluminium alloy wire material according to claim 1, wherein the aluminium alloy further contains Fe of 0.02 to 0.15 mass % and Ti of 0 to 0.10 mass %.

4. The aluminium alloy wire material according to claim 2, wherein the aluminium alloy further contains Fe of 0.02 to 0.15 mass % and Ti of 0 to 0.10 mass %.

5. The aluminium alloy wire material according to claim 1, wherein an electrical conductivity at the room temperature is equal to or higher than 55% IACS.

6. The aluminium alloy wire material according to claim 2, wherein an electrical conductivity at the room temperature is equal to or higher than 55% IACS.

7. The aluminium alloy wire material according to claim 1, wherein the aluminium is equal to or greater than 98.4 mass %.

8. The aluminium alloy wire material according to claim 2, wherein the aluminium is equal to or greater than 98.4 mass %.

9. The aluminium alloy wire material according to claim 2, wherein the aluminium alloy does not contain Co.

* * * * *